US005893576A

United States Patent [19]

Hauglin

[11] Patent Number: 5,893,576

[45] Date of Patent: Apr. 13, 1999

[54] CROSS-COUNTRY SKI BINDING WITH REPLACEABLE SIDE CABLE LENGTH ADJUSTOR

[75] Inventor: Bernt-Otto Hauglin, Royken, Norway

[73] Assignee: Rottefella AS, Klokkarstua, Norway

[21] Appl. No.: 09/016,037

[22] Filed: Jan. 30, 1998

[51] Int. Cl.[6] ..... A63C 9/086

[52] U.S. Cl. ..... 280/621; 280/615

[58] Field of Search ..... 280/615, 619, 280/622, 614, 620, 621, 633, 624

[56] References Cited

U.S. PATENT DOCUMENTS

| | | | |
|---|---|---|---|
| 2,181,794 | 11/1939 | Schlytter . | |
| 2,187,537 | 1/1940 | Bruun | 280/614 |
| 2,600,688 | 6/1952 | Ruege | 280/614 |
| 2,907,574 | 10/1959 | Goy et al. | 280/619 |
| 5,499,838 | 3/1996 | Hauglin et al. . | |

FOREIGN PATENT DOCUMENTS

| | | |
|---|---|---|
| 801546 | 8/1936 | France . |
| 603854 | 10/1934 | Germany . |
| 194783 | 3/1938 | Switzerland . |

*Primary Examiner*—Robert J. Oberleitner
*Assistant Examiner*—Faye M. Fleming
*Attorney, Agent, or Firm*—Andrus, Sceales, Starke & Sawall

[57] ABSTRACT

A cross-country ski binding, especially a hiking ski binding which includes a toe iron adapted for mounting on a ski top and having cheeks and sole catches for the front part of a ski boot sole. A heel unit has a cable with end tension springs. Corresponding side cable units connect the tension springs to the toe unit. Each cable unit includes a side cable with a forward end releasaby connected to the toe iron unit. A close wound coil spring is slidable on the side cable between the forward end and a rear stop member. A threaded connecting member has an internal thread and is threaded on the coil spring. The connecting member has an external threaded into the forward end of the tension spring. The threaded position on the sliding closely wounds coil spring with its movement on the cable.

8 Claims, 2 Drawing Sheets

CROSS-COUNTRY SKI BINDING WITH REPLACEABLE SIDE CABLE LENGTH ADJUSTOR

BACKGROUND OF THE INVENTION

The invention is directed to a cross-country ski binding, especially a hiking ski including a Telemark binding with replaceable side cable length adjustor.

The binding includes a toe iron adapted to be mounted on the top of a ski. The toe iron includes cheeks and sole catches for accommodating and supporting the front part of the sole of a ski boot on the sides, front and upper portions. A tension cable unit is adapted to be passed around the heel of the boot and coupled to a tensioning mechanism through tension springs and side cable units for fixing the ski boot to the toe iron such that during cross-country skiing the boot heel and the heel of the skier's foot may be raised from the ski top.

A particularly satisfactory binding is disclosed in U.S. Pat. No. 5,499,838 which issued to Hauglin et al on Mar. 19, 1996. The ski binding includes a heel unit with a cable tightening mechanism including a pivoted lever and connected by side tension springs to a single toe cable extended about a toe iron unit. The connection of the toe cable to the tension springs includes a length adjustment mechanism. One connection includes a threaded rod connected to the toe cable and threaded into the one tension spring. The opposite side connection to the toe cable includes a threaded member slidably mounted on the toe cable with separate internal length adjustment elements and with the threaded member threaded into the end of the opposite tension spring. The threaded member is held on the cable by an end enlargement on the cable.

Swiss Patent 194,783 discloses a different loop binding in which a heel coil spring is connected to a lock cable coil spring with a multi-part threaded coupling to heel encircling spring for length adjustment. The threaded adjustment varies the closed extension of the encircling spring and the force thereof.

Further, it may be necessary with the known binding to adapt the heel of the boot to the tension spring which is to be passed thereabout, for instance, in the form of a groove formed on the heel in which the tension spring must be placed before the binding can be locking in place. Alternative cable assemblies include separate side connecting cable units which are separately connected between a heel unit and a toe iron unit. Such constructions are shown in German patent 603,854. In the '854 patent, various couplings are shown between a heel unit and a toe iron unit including various side cable interconnections with a length adjustment made within the coupling at the heel unit.

The dual side cable connection has the advantage that if either side cable unit is damaged, only the damaged cable unit need be replaced rather than the total connection to the heel unit.

SUMMARY OF THE INVENTION

The present invention is directed to an improvement in the connection of the toe cable connection shown in the Hauglin et al '838 patent, and particularly to providing a dual side cable system in which identical side cable units are preferably connected between the heel unit and the toe iron unit. The side cable units particularly include an improved length adjustment mechanism.

In accordance with the present invention, the side cable unit of the binding includes a side cable unit having a cable with a toe iron coupling member at the forward or outer end and having a stop member at the rearward or inner end. An elongated side cable coil spring of a lesser length than the cable is slidably mounted on the side cable between the coupling member and the stop member. The coil spring is close wound to define an outer thread on the surface. A connecting member has an inner thread and is threaded to the cable coil spring. The connecting member also includes an outer thread and is threaded into the forward or outer end of a tension spring, with the side coil spring and stop member projecting into the tension spring. With the heel lever released, the tension spring releases and the connecting member and cable coil spring is movable for separation of the boot from the binding.

More particularly, in a preferred embodiment, a cross-country ski binding supports a ski boot having a sole for engaging the ski. A forward toe iron unit is secured to the ski. A heel engaging member is movable on the heel engaging member for releasably securing the binding to the boot. A heel unit is adapted to be mounted about the heel of a ski boot and includes a heel engaging member with having end tension springs. Right and left side cable units each include a first releasable connector for connection to the toe iron unit and a second releasable connector for connection to the corresponding right and left end tension springs, each of said right and left side cable units being constructed with a cable member extending from the first releasable connector rearward and terminating in a stop member secured to the rearward end portion of the cable member, a close-wound coil spring slidably disposed on the side cable between said first connector and the stop member and being of a shorter length than said cable, a second releasable connector including a threaded connector member threaded onto said coil spring and having a rearward connecting end, the tension spring being secured to the corresponding rearward connecting end of the second releasable connector, the threaded connector member is threaded onto the coil spring to vary the positioning and adjustment of the spacing of the heel unit from said toe iron unit and thereby adjusting the effective length of the binding.

The side cable unit provides a simple reliable assembly which is readily and replaceably connected in the binding. The adjustment of the ski binding length is quickly and easily adjusted to the proper length as required. Replacement is also quickly and easily made by simple release of the threaded connection of the threaded connecting member from the tension spring. The side cable unit construction thus provides an efficient cost effective binding for a ski binding.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DESCRIPTION OF THE ILLUSTRATED EMBODIMENT

Figure 1:
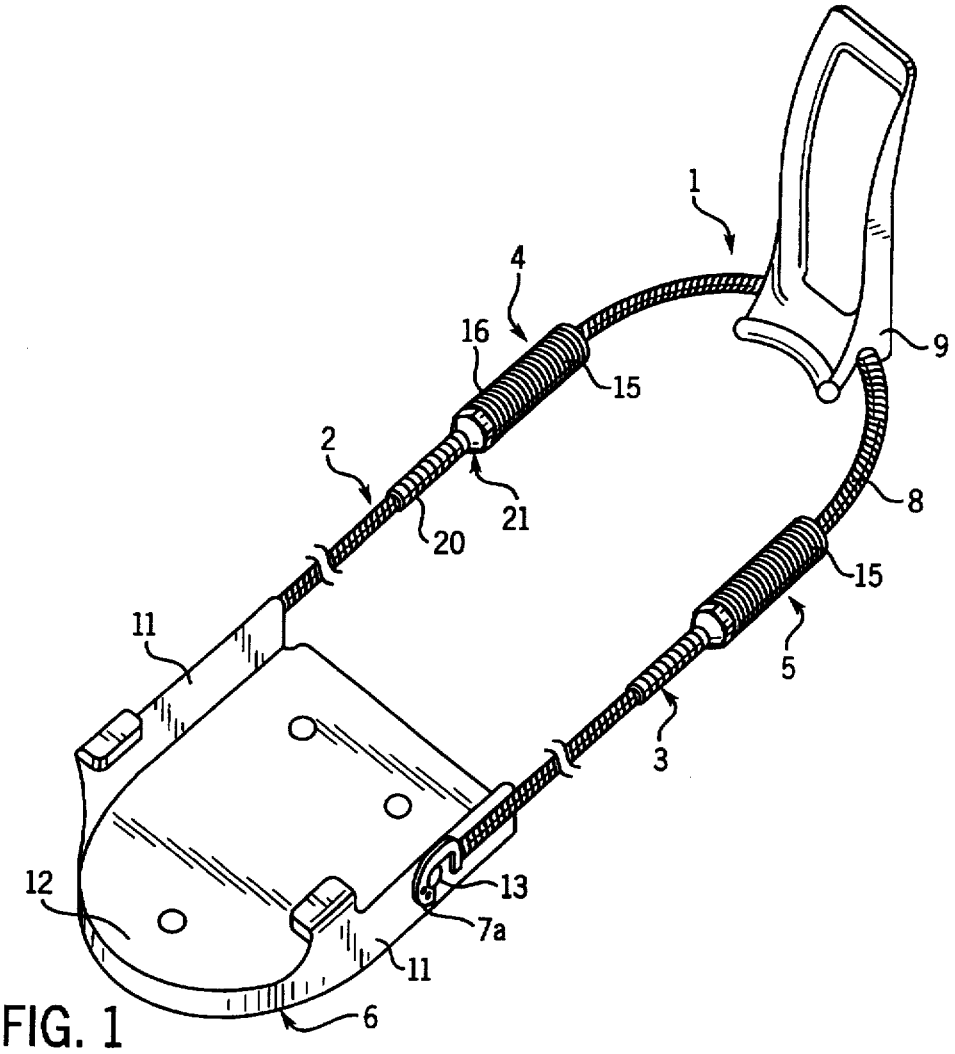
FIG. 1 is a pictorial view of a cross-country ski binding including dual side cable units illustrating an embodiment of the present invention.
Figure 4:
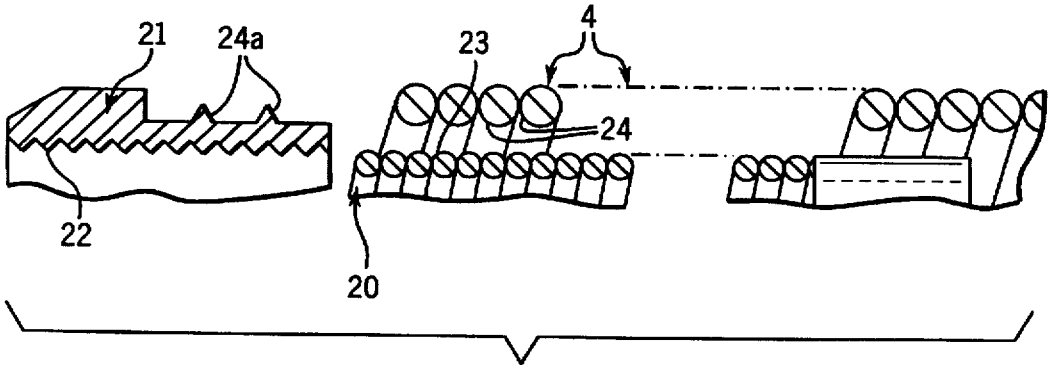

The illustrated embodiment of the ski binding is a dual side cable assembly including a heel cable unit 1 and right and left side cable units 2 and 3. Tension springs 4 and 5 of the heel cable unit 1 are releasably connected to the right and left side cable units 2 and 3 which are secured to a toe iron unit 6 by suitable, releasable couplings 7 and 7*a*. The heel cable unit 1, such as more fully disclosed in the Hauglin '838 patent, includes a heel cable, shown as a rigid bracket 8, secured to the rearward ends of the tension springs 4 and 5, and a lever 9 is pivoted on bracket 8 to releasably engages the heel of a ski boot to retract the heel cable unit and draw the side cable units rearwardly through an extension of the tension springs 4 and 5 to secure the binding to the boot.

More particularly, the cross-country ski binding as shown in FIG. 1 comprises a toe iron unit 6 for mounting on the top of a ski and having two cheeks 11 and sole catches 12 for accommodating and supporting the front part of the sole of a ski boot sideways, forwards and upwards. The rearward portion of the toe iron unit 6 includes side cable connector members 13 for releasably connection with the couplings 7 and 7*a* of the side cable units 2 and 3, as hereinafter described. Further, the cross-country ski binding illustrated in FIG. 1 includes the bracket 8 which is passed about the heel of the boot and is coupled to the tension springs 4 and 5 for fixing the ski boot (not illustrated) to the toe iron unit such that during cross-country skiing or ski hiking the ski boot heel or the heel of the skier may be raised from the ski top. Each tension springs 4 and 5 is a helical tension spring to produce a tensioned securement of the binding to the ski boot.

The tensioning mechanism is constituted by a tightening lever 9 which is pivotally mounted on the bracket 8 which is passed around the boot heel. The lever 9 is shown as an L-shaped member which bears against the boot sole in the tightening position. In the illustrated embodiment, the bracket 8 is a solid, relatively rigid wire bracket which simultaneously forms the swivel axis for the tightening lever 9. The swivel axis 14 of the tightening lever 9 extends in parallel to the bracket 8. The illustrated mechanism is shown in the Haughlin et al '838 patent as well as various other systems which might be used with the present invention and no further description is deemed necessary herein.

The bracket 8 is connected to the tension springs 4 and 5 by an enlargement 15 in the form of an integral or separate member at the ends of the bracket. The tension springs 4 and 5 are thus freely rotatable on the bracket ends. The opposite ends of springs 4 and 5 are formed, as at 16, to form an internal thread portion for connection to the side cable units 2 and 3, as presently described.

Figure 2:
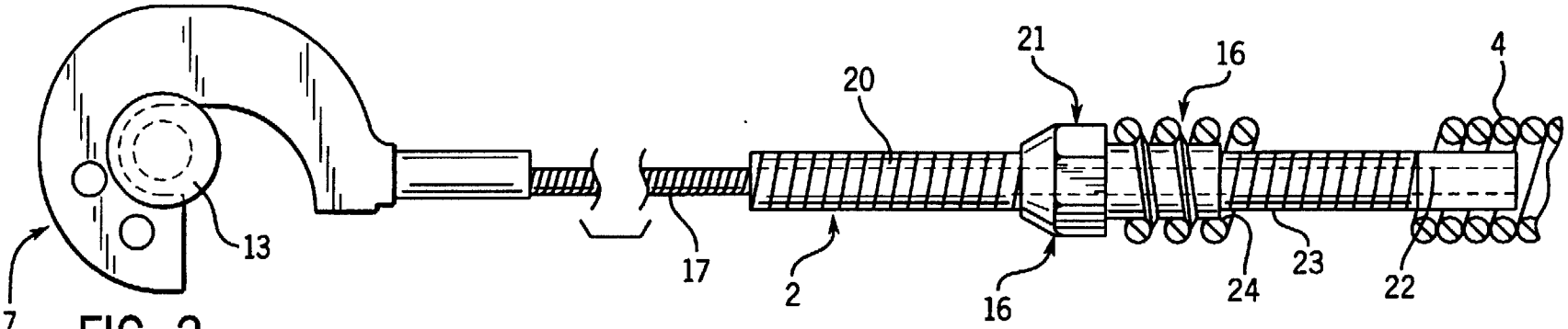
FIG. 2 is an enlarged side view of a side cable unit shown in FIG. 1.
Figure 3:
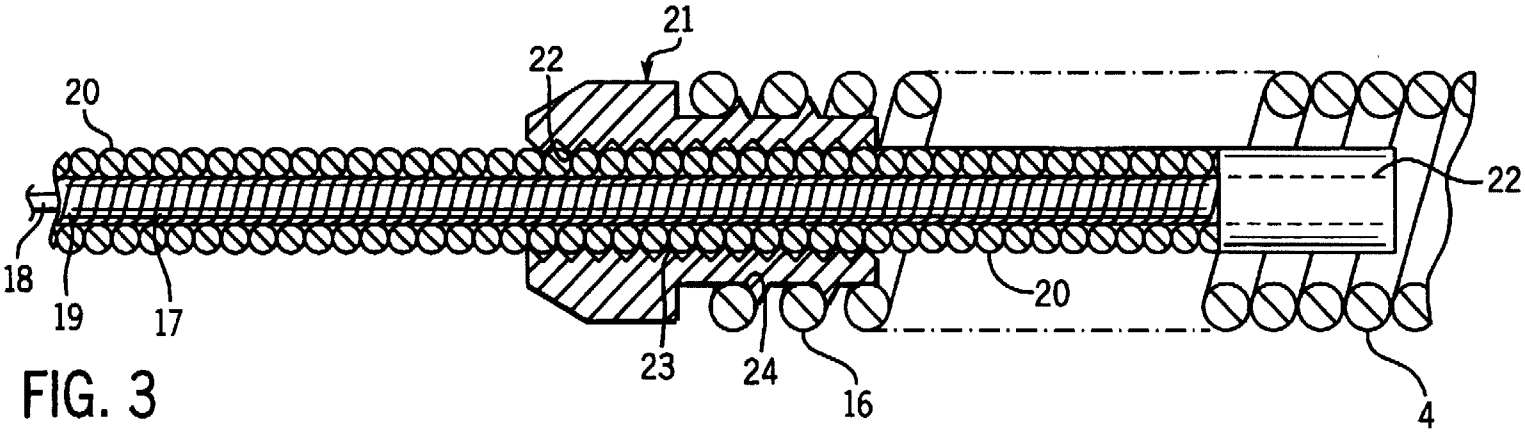
FIG. 3 is a longitudinal sectional view of FIG. 2.

In accordance with the illustrated embodiment of the present invention, the side cable units 2 and 3 are of the same construction. FIGS. 2 and 3 are enlarged illustrations of the right side cable unit 2 for purposes of describing the illustrated embodiment.

The side cable unit 2 includes an elongated and flexible cable 17 including and an inner core 18 of suitable high strength such as a metal wire. The core 18 may have an outer cover 19. The cable 17 has at least limited flexibility to permit the desired upper movement of the heel and boot relative to the toe iron unit and the ski. A coupling 7 is secured to the forward end of the cable 17 to the toe iron unit 6.

The illustrated coupling member 7 is a hook-shaped member which releasably and pivotally engages the connector member 13 of the toe iron unit 6. The illustrated coupling of the side cable unit is a known releasable connector and no further description is necessary. Any other releasable connection or coupling may be provided.

A coil spring 20 is slidably mounted on the cable 17 and extends through a connecting member 21 forming the outer diameter of the coil spring 20 corresponding generally to a stop member secured to the rearward end of cable 17. The stop member 21 limits the rearward movement of the coil spring 20 on the cable 17 during the locking of the binding to the boot. The coupling member 7 limits the forward movement of the coil spring with the binding released. The coil spring 20 is closely wound and forms an outer surface with a screw thread 23.

A connecting member 21 is a single piece tubular member having an internal thread 22 matching the thread defined by the closely wound side coil spring 20. The rearward end of the tubular connecting member 21 has an external thread 24*a* matching an internal thread 24 defined by the formed forward end of the tension spring 4. The connecting member 21 is releasably secured to the tension spring 4 by the threaded connection. The connecting member 21 is threaded onto the coil spring 20 to locate the same relative to the opposite ends of the cable unit and thereby the length of the binding. The connecting member 21 and tension spring 4 may move as a during the positioning of the connecting member 21 on the coil spring 20. The connecting member 21 and the coil spring 20 projects into and moves within the tension spring 4 as the connecting member 21 is threaded on the coil spring 20 to adjust the effective length of the side cable unit 2. The position of the connecting member 21 on the side coil spring 20 establishes the spacing of the toe iron coupling 7 relative to the tension spring 4 and the heel wire or bracket 8. This adjustment establishes the operative or effective length of the binding.

The side cable unit 2 is thereby releasably connected to the toe iron unit 6, at coupling 7, and to the heel unit and particularly the tension spring 4 at the threaded connection of the connecting member 21. The connecting member 21 is released by rotating the tension spring relative to the connecting member.

The opposite side cable unit 3 is constructed and releasably connected between the tension spring 5 and the coupling mechanism on the opposite side of the toe iron unit 6.

If the side cable unit fails, is damaged or does not operate properly for any reason, the cable unit is removed from the iron toe unit, and then from the tension spring by relative turning of the connector member 21 and the tension spring.

Although described in the preferred dual side cable units of identical structures, the present inventions may be readily applied to a loop binding or other binding with a single side cable unit of the above disclosed system and an opposite side cable unit of any other suitable constructions. Further, the slide member of the side cable unit and the connecting member may include other mechanical connection to adjustably secure the connecting member to the slide member for adjusting the operative length of the side cable unit.

All features disclosed in the present application papers are claimed as being essential to the invention insofar as they are novel over the prior art both individually and in combination.

I claim:

1. A cross-country ski binding supporting a ski boot having a sole for engaging the ski, comprising a forward toe iron unit and attachment structure for securement to the ski, a heel unit adapted to be mounted about the heel of a ski boot and having end tension springs, right and left cable units each having a first releasable connector for connection to the toe iron and a second releasable connector for connection to the corresponding right and left end tension springs, at least one of said right and left cable units being constructed with a cable member extending from the first releasable connector rearward and terminating in a stop member secured to the rearward end of the cable member, a sliding coil spring slidably disposed on said cable between said first connector and said stop member and being of a shorter length than said cable, said second releasable connector including a threaded connector member threaded to said coil spring and having a rearward connecting end, said tension spring being secured to the corresponding rearward connecting end of said second releasable connector whereby threading of said threaded connector member on said coil spring results in the positioning adjustment of the spacing of said heel unit from said toe iron and thereby adjusting the effective length of the binding.

2. The binding of claim 1 wherein said rearward connecting end of said second releasable connector includes an external thread, said tension spring is a coil spring threaded to said external threaded to secure the tension to the connector.

3. The binding of claim 1 or 2 wherein both the right and left cable units have the same structure.

4. The binding of claim 1 wherein said heel unit includes a cable, a heel engaging member pivoted on said cable, and the first and second tension springs are secured one each to the ends of said cable and thereby to said toe cable units.

5. A side cable unit for a ski binding having a heel unit adapted to be connected to an opposite side of a toe iron unit and having at least one end tension coil spring, said ski binding including at least one replaceable side cable unit connecting the tension spring of the heel unit to the toe iron unit, said replacement toe cable unit including a flexible cable having a forward end for connection to said toe iron unit and a rearward end for interconnection to said tension spring, a sliding coil spring slidably mounted on said flexible cable and having an inner diameter closely related to the diameter of said cable and closely wound around said cable, a releasable threaded connector to said tension spring and having an inner thread and threaded onto said sliding coil spring, a stop member secured to the rearward end of said cable restricting the rearward movement of said sliding coil spring and of said releasable threaded connector and having an outer diameter allowing free movement of the cable including said stop member within said tension spring, and said sliding coil springs having a length between said toe iron connecting member and said stop member less than the length of said connecting cable whereby the threaded positioning of said connecting member on said sliding coil spring establishing adjustment in the length between said tension spring and said toe unit.

6. The side cable unit of claim 5 wherein said cable has a front coupling hook member for releasable connection to a toe iron unit.

7. The side cable unit of claims 5 or 6 wherein said threaded releasable connector is a single piece tubular member having said inner and outer threads.

8. The side cable unit of claim 7 wherein said threaded releasable connector includes an outer head portion abutting the tension spring.

* * * * *